United States Patent [19]

Shibata

[11] 4,452,651

[45] Jun. 5, 1984

[54] ELECTRICAL CONTACT MATERIALS AND THEIR PRODUCTION METHOD

[75] Inventor: Akira Shibata, Yokohama, Japan

[73] Assignee: Chugai Denki Kogyo K.K., Tokyo, Japan

[21] Appl. No.: 396,244

[22] Filed: Jul. 8, 1982

[51] Int. Cl.[3] ..... C22C 5/06

[52] U.S. Cl. ..... 148/431; 420/501

[58] Field of Search ..... 420/501, 502, 503, 504, 420/505, 506; 148/431

[56] References Cited

U.S. PATENT DOCUMENTS

| | | | |
|---|---|---|---|
| 3,785,810 | 1/1974 | Dürrwächter et al. | 148/431 |
| 4,161,403 | 7/1979 | Shibata | 148/431 |
| 4,243,413 | 1/1981 | Shibata | 148/431 |

FOREIGN PATENT DOCUMENTS

| | | | |
|---|---|---|---|
| 2933338 | 2/1981 | Fed. Rep. of Germany | 420/501 |
| 1416537 | 12/1975 | United Kingdom | 420/501 |

*Primary Examiner*—L. Dewayne Rutledge
*Assistant Examiner*—S. Kastler
*Attorney, Agent, or Firm*—Shlesinger, Fitzsimmons & Shlesinger

[57] ABSTRACT

An aggregate and/or integrate comprising of silver and tin oxides and/or tin alloy oxides of 4–25 weight % which have been prepared to have the oxides disperse uniformly in the silver, are subjected to a temperature about the melting point of silver, whereby an electrical contact material made from said aggregate and/or integrate comes to have a continuous silver matrix as if produced by an internal oxidation method and also to have such uniform dispersion of the metal oxides in said silver matrix which is comparable or superior to that producible by a powder metallurgical method. The contact material has an excellent elongation and high conductivity.

3 Claims, No Drawings

ELECTRICAL CONTACT MATERIALS AND THEIR PRODUCTION METHOD

BACKGROUND OF THE INVENTION

Electrical contact materials dispersed with metal oxides, particularly cadmium oxides or tin oxides in silver matrices are widely employed in the electrical industry today.

Such silver-metal oxides electrical contact materials are generally produced either by a powder metallurgical method or internal oxidation method. In the powder metallurgical method, silver powders which constitute matrices of a contact material and powders of metal oxides are mixed at a desired ratio, and are sintered at a temperature below the melting points of constituent metals after having been molded into a green compact, while in the internal oxidation method, after a molten alloy of silver and solute metal(s) of a specific amount has been cast and pressed into a desired shape of a certain thickness, the alloy is subjected to internal oxidation so that the solute metal(s) is selectively oxidized.

Such silver base electrical contact materials prepared either by the powder metallurgical method or internal oxidation method are certainly improved of their refractoriness on account of the dispersion of metal oxides in silver matrices. However, they are not free from certain drawbacks. To wit, those prepared by the powder metallurgical method are brittle and hence lack in elongation. Their lives are inferior to those prepared by the internal oxidation method. On the other hand, those prepared by the internal oxidation method are good in elongation and have a high conductivity, while their solute metals are limited for amount and kind. In addition, the dispersion and size of metal oxides precipitated in or about silver matrices are not so even as those prepared by the powder metallurgical method.

Hence, it is an object of this invention to provide an electrical contact material having a good elongation and high conductivity, silver base of which has been melted and solidified presenting a continuous matrix, and fine particles of metal oxides, particularly tin oxides and/or tin alloy oxides of 4–25 weight % being dispersed uniformly throughout said silver matrix.

It is another object of this invention to provide a method or preparing the aforementioned kind of electrical contact materials.

BRIEF SUMMARY OF THE INVENTION

In this invention, an aggregate and/or integrate of silver and refractory metal oxides which comprise at least tin oxides and/or tin alloy oxides of 4–25 weight % and which are caused to disperse uniformly in silver, is subjected to a temperature about or higher than (i.e. approximately equal to or greater than). the melting point of silver (960° C.), whereby silver presents, when solidified, a continuous matrix.

Working principle of this invention lies in the following.

(1) Tin oxides and tin alloy oxides neither melt nor decompose at the melting point of silver.

(2) When silver melts in situ as a matrix metal of the aggregate and/or integrate, it inhales or absorbs atmospheric oxygen. High partial pressure thus produced in silver prevents metal oxides from migrating about and migrating into silver. It also prevents metal oxides from being converted to lower oxides on account of their exhalation or transfer of oxygen into silver. As silver solidifies, it exhales oxygen and impurities, and presents a continuous matrix of pure silver which is relieved from defective crystal structures and work strain and glide. Meanwhile, molten silver well wets fine particles or precipitates of metal oxides, and spreads thinly over their outer surfaces and therebetween, whereby they are kept uniformly dispersed and they remain as they were dispersed. Expressions used in this specification, "metal oxides being uniformly dispersed" or "uniform dispersion of metal oxides" mean such dispersion greater even than the dispersion of metal oxides precipitated in silver by the internal oxidation method, and such dispersion being comparable or superior to the dispersion of metal oxides in silver made by the powder metallurgical method.

(3) Tin oxides and/or tin alloy oxides of 4–25 weight % give good refractoriness to electrical contact materials made in accordance with this invention, while said amount of metal oxides does not deprive said contact materials of their good elongation and high conductivity. Said oxides may be replaced in part by oxides of Cd, Zn, Sb, Cu, In, Bi or others, or combination thereof. One or plurality of Fe, Co, Ni, and alkaline earth metals may also be added in a trace amount as constituents of the materials.

It is one of advantageous features of this invention that the heating to about the melting point of silver of an aggregate or integrate consisting of silver matrix and specific refractory metal oxides does not necessitate a specific atmosphere, but can be done under an atmospheric condition. Said heating may be made at, along with, or after sintering of the aggregate or integrate or combination thereof, or hot pressing, rolling, or extruding thereof. It shall be noted that said heating of the aggregate, integrate, or combination thereof to about the melting point of silver (960° C.) means such one under which silver comes to present a liquid phase, but neither intends to limit it to the heating by a specific kind of works or apparatuses, nor refers to an apparent temperatures of such works or apparatuses. It shall be noted also that the expression "aggregate" means such one as a sintered, hot worked, pre-sintered, or pre-hot worked compact or mixture which is made from silver matrix powders and metal oxides powders, and the expression "integrate" such one as a compound or melt, silver of which is solid with solute metals and metal oxides of which are precipitated in silver by the internal oxidation for example, and which comes to have the metal oxides disperse uniformly throughout the matrix of silver by works such as kneading, forging, rolling, pressing and so on. The materials of this invention can be prepared from a combination of the aggregate and the integrate.

It is further one of advantageous features of this invention that a silver back can be cladded to the contact material simultaneously and instantenuously with a step of subjecting the material to about the melting point of silver.

DETAILED DESCRIPTION OF THE INVENTION

This invention is described more in detail by way of the following examples.

EXAMPLE 1

90 weight % of silver oxides of black colour powders of about 0.1$\mu$ and 10 weight % of powdered tin oxides of about 0.05μ were mixed in a vibration mill with alcohol for 20 hours. The powders were well mixed, and their powder sizes were reduced respectively to about one half to one fifth of their starting sizes. The mixture was subjected to thermal decomposition treatment held at 400° C. and under air. The mixture thus treated was molded under 2–4 T/cm$^2$, and sintered at 800° C. of $O_2$ atmosphere for 2 hours. This sintered compact was repressed at 5–7 T/cm$^2$. The material had 5 mm thickness.

This contact material, that is, the one which was produced by a conventional powder metallurgical method, had the following physical properties.

Hardness (Vickers hardness): 80

Elongation (%): 2–3

Conductivity (IACS): 56

This specimen was abutted at its one of open flat surfaces with a pure silver plate of 0.1 mm thickness having serrations at a end surface not abutting with the specimen. This composite was subjected to a temperature of 1,050° C. for five minutes. Said serrations disappeared to indicate that the silver matrix of specimen was brought to its melting point.

This contact material made in accordance with this invention had the following physical properties.

Hardness (Vickers hardness): 89

Elongation (%): about 23

Conductivity (IACS): 60

Thus, it is confirmed that the material obtained by this invention has a hardness similar to the specimen, elongation of about ten times of the specimen, and a conductivity comparable or superior to those made by the internal oxidation method.

Microphotographic observation of the said material shows a clear distinctive contrast between the silver matrix and metal oxides.

EXAMPLE 2

An alloy was made by melting Ag-Sn 8 weight %- Bi 2 weight %- Co 0.1 weight %. Said alloy was atomized under $N_2$ gas atmosphere and collected as fine powders in liquid. The powders were of about 100 mesh. They were molded under 3 T/cm$^2$ to a compact of 150 mm in length, 4.5 mm in height, and 100 mm in width, which was backed by a silver plate of 0.5 mm in thickness. The compact with the silver back was sintered and internal oxidized in $O_2$ atmosphere at 800° C. for 30 minutes. Then, it was hot-rolled at 700° C. to obtain a plate of 1.0 mm in thickness. Disk shaped contacts of 6 mm in diameter and 1.0 mm in thickness were punched out from the plate. The contacts were subjected to 1,000° C. for 5 minutes at $O_2$ atmosphere.

They present excellent physical properties as the material of Example 1 has.

EXAMPLE 3

An alloy made by melting Ag- In 5 weight % was atomized at $N_2$ gas atmosphere to obtain powders of about 100 mesh. The said powders well mixed with 8 weight % of tin oxides powders of about 0.01μ were molded, backed with a thin pure silver plate, sintered and internal oxidized, hot-rolled, and punched out to disk shaped contact materials.

Said contacts of 6 mm in diameter and 1 mm in thickness were subjected to the $O_2$ atmosphere of 1,100° C. for 5 minutes. The contacts have an excellent elongation and high conductivity as explained in Example 1.

EXAMPLE 4

A melt of Ag- Sn 8 weight %- In 6 weight %—Co 0.2 weight % was continuously cast to a wire of 6 mm in diameter. The wire was drawn to a wire of 1.0 mm in diameter, which was cut to short wire pieces each of 1.0 mm in length. The short wire pieces were internally oxidized in $O_2$ atmosphere of 10 atm. for 12 hours. Then, they were compacted under 5 T/cm$^2$ to an ingot of 100 mm in diameter and 300 mm in length. The preheated ingot was extruded at 800° C. into 6 pieces of wire of 4 mm in diameter. Said wires were cut to discal contacts of 6 mm in diameter and 1.3 mm in thickness, which were cladded with silver of 0.2 mm in thickness. The discal contacts were subjected to 1,050° C. at $O_2$ atmosphere for 3 minutes. They had a good elongation and high conductivity as explained in Example 1.

EXAMPLE 5

An elongated plate of Ag- Sn 7 weight %- Bi 0.5 weight % melt alloy (of elongation of 1–3%) of 1.4 mm in thickness and 6 mm in width, which was cladded by silver of 0.1 mm in thickness, was internally oxidized for 12 hours in $O_2$ of 10 atm. of 700° C. By repeatedly heating it at 1,050° C. at $O_2$ atmosphere, the plate was rolled to 0.5 mm thickness. Elongation (%) of this plate was 25–30, that is, about ten times of that of the starting melt alloy.

I claim:

1. A method of preparing an electrical contact material, which comprises:

preparing a powder mixture of silver powders and powders of metal oxides, the metal oxides including tin oxides and/or tin alloy oxides and being 4–25 weight % of the total powder mixture, molding and sintering said powder mixture to a compact at a temperature lower than the melting temperature of silver, and heating said compact under normal atmospheric conditions, to a temperature greater than the melting temperature of silver thereby to have the silver powders in the compact melt and absorb atmospheric oxygen thereinto so as to produce therein a high partial pressure which prevents the metal oxides from migrating into the molten silver and also prevents them from converting to lower oxides on account of their transfer of oxygen into the silver, the atmospheric oxygen absorbed by the silver being exhausted therefrom with impurities contained therein upon the cooling of the compact.

2. A method of producing an electrical contact material as claimed in claim 1, in which said compact is cladded with a silver back and then subjected to a temperature approximately equal to or greater than the melting point of silver, whereby said silver back is melted and solidifies to said compact simultaneously and instantenously with the solidification and formation of a continuous silver matrix.

3. A method of producing an electrical contact material as claimed in claim 1, in which the mixture is molded and sintered with a silver back.

* * * * *